US008470084B2

(12) United States Patent
Ji et al.

(10) Patent No.: US 8,470,084 B2
(45) Date of Patent: Jun. 25, 2013

(54) ELECTRIC PRECIPITATOR AND HIGH VOLTAGE ELECTRODE THEREOF

(75) Inventors: Jun Ho Ji, Namyangju-si (KR); Kochiyama Yasuhiko, Seongnam-si (KR); Hyong Soo Noh, Suwon-si (KR); So Young Yun, Suwon-si (KR); Han Wook Cho, Giheung-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 653 days.

(21) Appl. No.: 12/591,736

(22) Filed: Nov. 30, 2009

(65) Prior Publication Data

US 2010/0147151 A1 Jun. 17, 2010

(30) Foreign Application Priority Data

Dec. 11, 2008 (KR) ..... 10-2008-0126184

(51) Int. Cl.
*B03C 3/40* (2006.01)

(52) U.S. Cl.
USPC ..... 96/69; 96/76; 96/95; 96/98; 313/355

(58) Field of Classification Search
USPC ..... 96/69, 70, 76–79, 95, 98, 99; 313/352, 313/355
See application file for complete search history.

(56) References Cited

U.S. PATENT DOCUMENTS

| | | | | | |
|---|---|---|---|---|---|
| 4,354,861 | A * | 10/1982 | Kalt | 96/69 |
| 5,215,558 | A * | 6/1993 | Moon | 96/62 |
| 6,004,376 | A * | 12/1999 | Frank | 95/79 |
| 6,117,403 | A * | 9/2000 | Alix et al. | 423/210 |
| 6,761,752 | B2 * | 7/2004 | Fissan et al. | 95/74 |
| 7,077,890 | B2 | 7/2006 | Botvinnik | |
| 7,150,780 | B2 * | 12/2006 | Krichtafovitch et al. | 96/72 |
| 7,258,730 | B2 * | 8/2007 | Choi et al. | 96/69 |
| 7,294,176 | B2 * | 11/2007 | Kim et al. | 96/69 |
| 2004/0226448 | A1 * | 11/2004 | Griffiths et al. | 96/67 |
| 2006/0227486 | A1 * | 10/2006 | Kim et al. | 361/120 |
| 2009/0165648 | A1 * | 7/2009 | Frank et al. | 95/73 |

FOREIGN PATENT DOCUMENTS

| | | | | |
|---|---|---|---|---|
| JP | 52-7076 A * | 1/1977 | | 96/76 |
| KR | 10-0206774 | 4/1999 | | |
| KR | 10-2003-0021889 | 3/2003 | | |
| KR | 20-0363531 | 9/2004 | | |

* cited by examiner

*Primary Examiner* — Richard L Chiesa
(74) *Attorney, Agent, or Firm* — Staas & Halsey LLP

(57) ABSTRACT

An electrode precipitator having a high voltage electrode and a low voltage electrode arranged apart from each other at a desired interval. The high voltage electrode includes a charging part which is positioned upstream of an air flow direction to charge a pollutant, and a dust collection part which is spaced from the charging part and positioned downstream of the air flow direction to precipitate the charged pollutant therein.

17 Claims, 7 Drawing Sheets

ELECTRIC PRECIPITATOR AND HIGH VOLTAGE ELECTRODE THEREOF

CROSS-REFERENCE TO RELATED APPLICATIONS

This application claims the benefit of Korean Patent Application No. 2008-0126184, filed on Dec. 11, 2008 in the Korean Intellectual Property Office, the disclosure of which is incorporated herein by reference.

BACKGROUND

1. Field

Embodiments of the present invention relate to an electric precipitator for collection of foreign materials or pollutants such as dust by electric attraction.

2. Description of the Related Art

An electric precipitator is generally mounted on an air conditioner. More particularly, the electric precipitator is arranged on an air flow path to collect foreign materials or pollutants such as dust (hereinafter, referred to as 'pollutant') contained in air passing through the electric precipitator by electric attraction.

A conventional electric precipitator generally has a double-stage type structure to precipitate a pollutant, including a charging part which is positioned upstream of an air flow direction to charge a pollutant, and a dust collection part which is positioned downstream of the air flow direction to precipitate the charged pollutant therein.

In such a double-stage type electric precipitator, the charging part includes a discharge electrode in a wire form to fabricate an anode and a pair of ground electrodes, which are located at both sides of the discharge electrode and spaced apart from the discharge electrode at a certain interval in order to fabricate a cathode. Also, the dust collection part includes plural high voltage electrodes and plural low voltage electrodes, which are alternately arranged and spaced from one another.

However, in order to generate a discharge between an electric wire and a ground electrode, such a conventional electric precipitator requires a considerably high voltage to be applied to the discharge electrode, thus requiring a large scale power supply to apply high voltage and increasing electric power consumption.

Furthermore, since high voltage is applied to the discharge electrode as described above, the discharge electrode must be sufficiently spaced from the dust collection part in consideration of safety, and therefore, it is difficult to reduce a width of the electric precipitator below a certain level.

SUMMARY

Therefore, it is an aspect of the invention to provide an electric precipitator fabricated with a considerably small width so as to more efficiently utilize a space for installation thereof.

Additional aspects and/or advantages will be set forth in part in the description which follows and, in part, will be apparent from the description, or may be learned by practice of the invention.

The foregoing and/or other aspects of the present invention are achieved by providing a high voltage electrode and a low voltage electrode arranged apart from each other at a desired interval in the precipitator. The high voltage electrode includes a charging part to charge the pollutant, and a dust collection part spaced from the charging part and positioned downstream from the charging part in an air flow direction to precipitate the charged pollutant therein.

The high voltage electrode includes: a pair of film parts which are made of a non-conductive material and are combined together; a first electrode layer which is arranged to be exposed outside the film parts to form the charging part; and a second electrode layer which is located between the film parts to form the dust collection part.

The first electrode layer is placed on one of the paired film parts while the other of the film parts has a through-hole to expose the first electrode layer.

The first electrode layer may be formed by a pair of electrode layers which are arranged on the paired film parts, respectively, and each of the film parts may have a through-hole to expose the first electrode layer arranged on the film parts.

The high voltage electrode has the same width as that of the low voltage electrode and these electrodes are alternately arranged with and spaced from each other.

The high voltage electrode includes a first high voltage electrode which comprises the charging part and the dust collection part, and a second high voltage which includes, only the charging part. On the other hand, the low voltage electrode includes a first low voltage electrode having the same width as that of the first high voltage electrode and a second low voltage electrode having the same width as that of the second high voltage electrode.

The first high voltage electrode is spaced from the first low voltage electrode, while at least one pair of the second high voltage electrode and the second low voltage electrode is arranged between the first high voltage electrode and the first low voltage electrode.

The first electrode layer may be fabricated using conductive fibers.

The electric precipitator according to the aspect of the present invention may further include a power supply to provide electric power to the high voltage electrode, wherein the power supply applies electric power with different voltages to the charging part and the dust collection part.

Alternatively, the electric precipitator may further include a power supply to provide electric power to the high voltage electrode, as well as a resistor to connect the charging part and the dust collection part, wherein the power supply is connected only to either the charging part or the dust collection part.

The foregoing and/or other aspects may also be achieved by providing a high voltage electrode to collect a pollutant, including a charging part which is positioned to charge the pollutant, and a dust collection part which is spaced from the charging part and is positioned downstream relative to the charging part in an air flow direction to precipitate the charged pollutant therein.

Briefly, the electric precipitator according to an exemplary embodiment of the present invention includes the charging part to charge a pollutant on the high voltage electrode and the dust collection part to precipitate the charged pollutant, so that the electric precipitator has a considerably reduced width and therefore can more efficiently utilize space for installation thereof.

In addition, the electric precipitator according to the exemplary embodiment of the present invention has the first electrode layer for fabrication of the charging part, which is made of conductive fibers to generate a discharge even at a low voltage, so that a small scale power supply may be used and electric power required to operate the electric precipitator may be considerably reduced.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
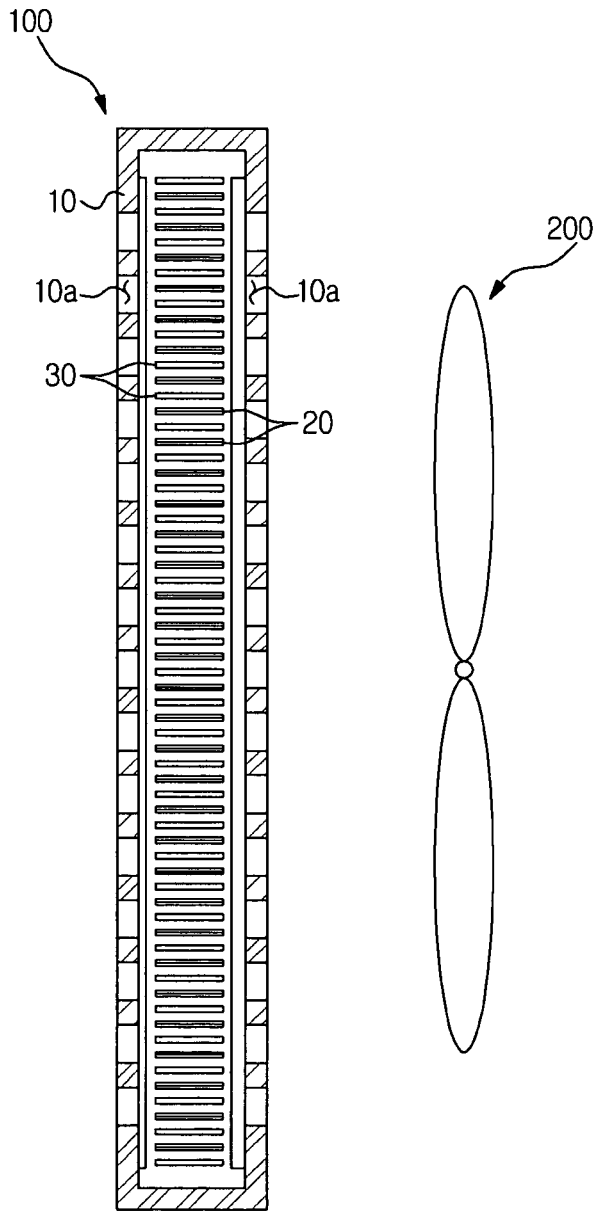
FIG. 1 is a cross sectional view illustrating an electric precipitator according to an exemplary embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

An electric precipitator according to an exemplary embodiment of the present invention will be described in detail with reference to the accompanying drawings.

As shown in FIG. 1, an electric precipitator 100 according to the exemplary embodiment is a device for collection of foreign materials or pollutants such as dust contained in air, typically arranged on an air flow path through which the air flows by an air blowing fan 200. The electric precipitator 100 includes a frame 10 which constitutes an outer shape of the electric precipitator 100 and has grid type vent holes 10*a* provided at both sides thereof to pass air in a single direction through the vent holes; a plurality of high voltage electrodes 20 arranged in the frame 10 to precipitate a pollutant such as dust; and a plurality of low voltage electrodes 30 which have the same width as that of the high voltage electrodes 20 and are alternately arranged with and spaced from the high voltage electrodes 20.

Figure 2:
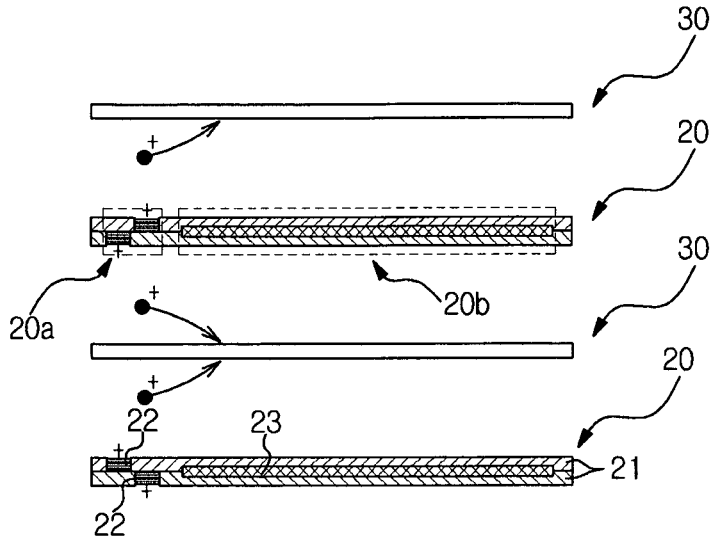
FIG. 2 is a schematic view illustrating the arrangement of high voltage electrodes and low voltage electrodes used in an electric precipitator according to the embodiment of the present invention shown in FIG. 1.

As shown in FIG. 2, the high voltage electrode 20 according to the embodiment shown in FIG. 1 includes a charging part 20*a* to positively charge a pollutant such as dust contained in air, as well as a dust collection part 20*b* to precipitate the charged pollutant. That is, the high voltage electrode 20 may also function as a discharge electrode provided in a double-stage type electric precipitator while the low voltage electrode 30 serves as a ground electrode in the same electric precipitator. In this embodiment, the low voltage electrode 30 serves as the ground electrode.

Figure 3:
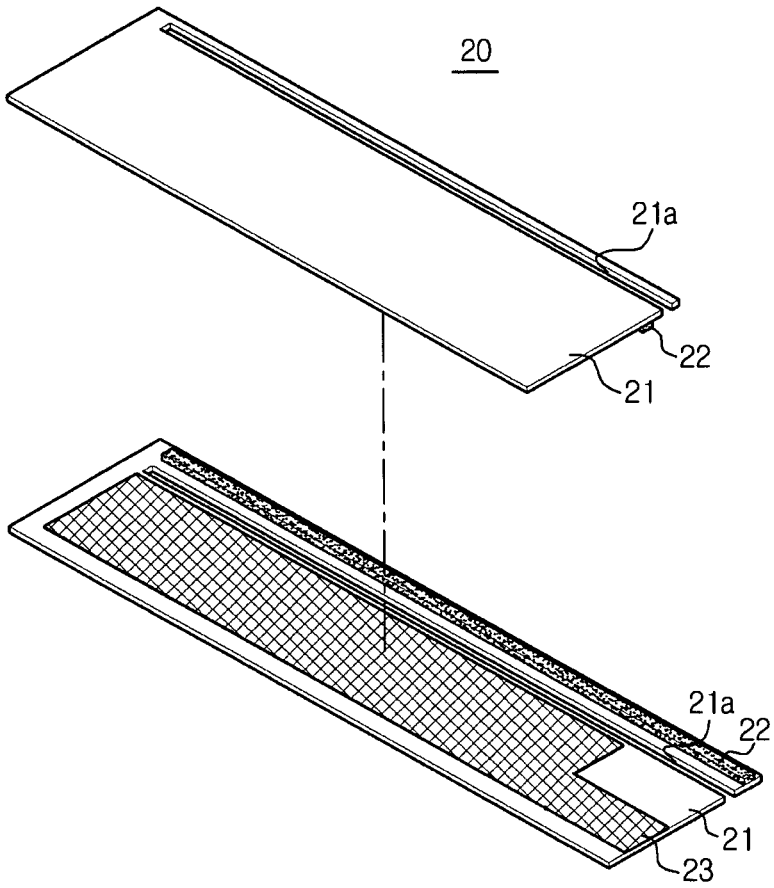
FIG. 3 is an exploded perspective view illustrating one of the high voltage electrodes used in the electric precipitator according to the embodiment of the present invention shown in FIG. 2.

As shown in FIG. 3, the high voltage electrode 20 further includes: a pair of film parts 21 which are made of any non-conductive material and are combined together; a first electrode layer 22 which is arranged to be exposed outside at least one of the film parts 21 to form the charging part 20*a*; and a second electrode layer 23 which is located between the film parts 21 to form the dust collection part 20*b*.

In the exemplary embodiment of the present invention, the first electrode layer may be fabricated using fine conductive fibers such as carbon fibers with a diameter of several to several tens of micrometers (□), carbon nanotubes, etc. When the fine conductive fibers are used to fabricate the first electrode layer 22, the first electrode layer 22 may generate a discharge even at a low voltage, thereby decreasing a capacity of a power supply P for the electric precipitator 100 and reducing electric power consumption.

The first electrode layer 22 may be positioned on one of the paired film parts while the other of the film parts may have a through-hole 21*a* to expose the first electrode layer 22. According to the embodiment shown in FIG. 2, the first electrode layer 11 is formed by a pair of electrode layers which are arranged at different positions on the film parts 21, respectively, and each of the paired film parts 21 may have a through-hole 21*a* at a position corresponding to the first electrode layer 22 arranged on the film parts 21.

Accordingly, applying high voltage positive power to the high voltage electrode 20 may generate a discharge between the first electrode layer 22 and the low voltage electrode 30 to positively charge a pollutant contained in air passing through the first electrode layer 22 and the low voltage electrode. The positively charged pollutant as well as the air may flow between the second electrode layer 23 and the low voltage electrode 30 so that the positively charged pollutant moves to the low voltage electrode 30 at a relatively low voltage, thus being trapped therein.

As disclosed above, if the charging part 20*a* fabricated by the first electrode layer 22 made of conductive fibers in the high voltage electrode 20 serves as a discharge electrode in a double-stage type electric precipitator, the first electrode layer 22 made of the conductive fibers can easily generate a discharge even at a low voltage so that a distance between the first electrode layer 22 and the second electrode layer 23 may be reduced. Accordingly, a space for installation of a discharge electrode and a ground electrode provided in a double-stage type electric precipitator may be omitted, although a width of the high voltage electrode 20 is slightly increased to arrange the first electrode layer 22 thereon. Therefore, the overall width of the electric precipitator 100 may be considerably reduced, compared to the typical double-stage type electric precipitator.

Hereinafter, an electric precipitator according to another embodiment of the present invention shown in FIG. 4 will be described in detail with reference to the accompanying drawings.

Figure 4:
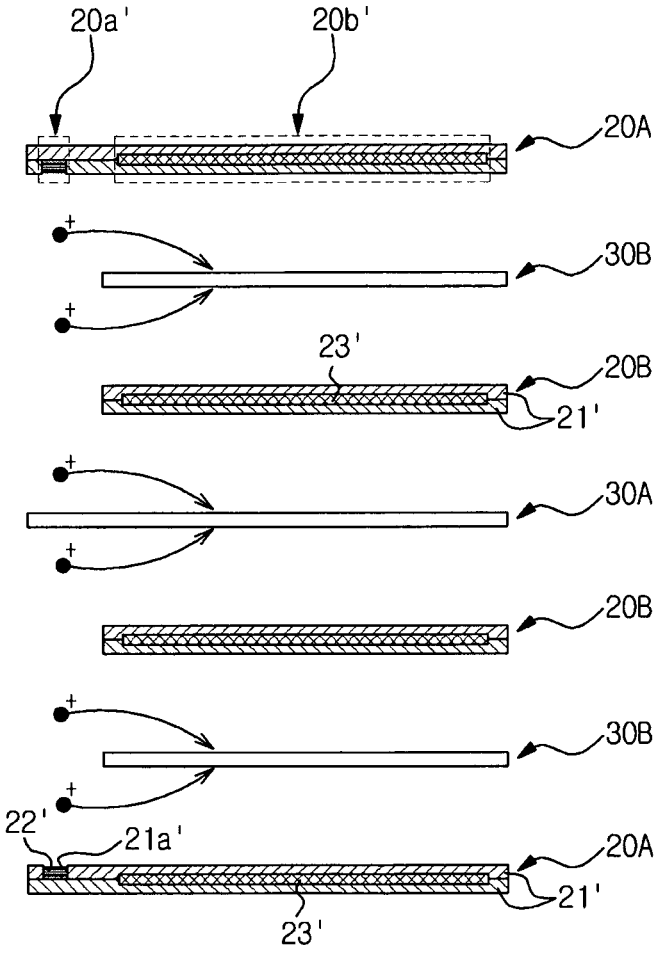
FIG. 4 is a schematic view illustrating the arrangement of high voltage electrodes and low voltage electrodes used in an electric precipitator according to another embodiment of the present invention.

As shown in FIG. 4, an electric precipitator according to this embodiment includes a plurality of high voltage electrodes 20A and 20B and a plurality of low voltage electrodes 30A and 30B.

The high voltage electrodes 20A and 20B include: a first high voltage electrode 20A, including a charging part 20*a*' which is positioned upstream of an air flow direction to charge a pollutant and a dust collection part 20*b*' to precipitate the charged pollutant in the low voltage electrodes 30A and 30B; and a second high voltage electrode 20B, including only another dust collection part 20*b*' without a configuration for the charging part 20*a*'. On the other hand, the low voltage electrodes 30A and 30B include a first low voltage electrode 30A having the same width as that of the first high voltage electrode 20A, as well as a second low voltage electrode 30B having the same width as that of the second high voltage electrode 20B. In this regard, the second high voltage electrode 20B is paired with the second low voltage electrode 30B and multiple pairs of these electrodes 20B and 30B may be arranged between the first high voltage electrode 20A and the first low voltage electrode 30A. As for the exemplary embodiment of the present invention, a pair of the second high voltage electrode 20B and the second low voltage electrode 30B is alternately arranged between the first high voltage electrode 20A and the first low voltage electrode 30A.

Figure 5:
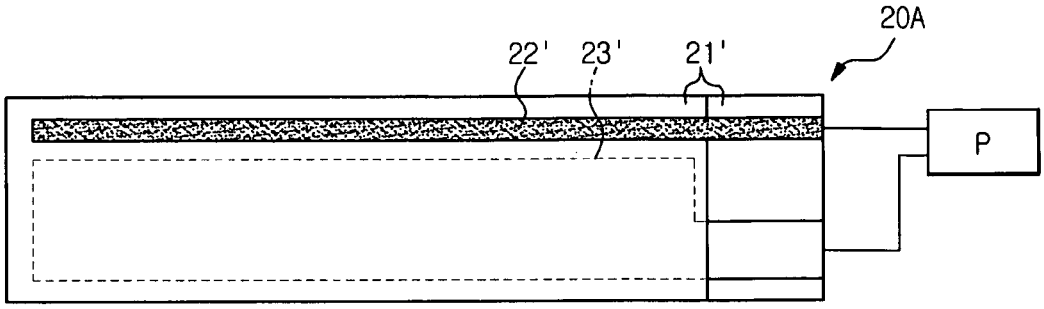
FIG. 5 is a schematic view illustrating the connection of a first high voltage electrode used in the electric precipitator according to the embodiment of the present invention shown in FIG. 4 to a power supply.

The first high voltage electrode 20A includes: a pair of film parts 21' which are made of a non-conductive material and are combined together; a first electrode layer 22' which is arranged to be exposed outside at least one of the film parts 21' to form the charging part 20*a*'; and a second electrode layer 23' which is located between the film parts 21' to form the dust collection part 20*b*'. On the other hand, the second high voltage electrode 20B includes: a pair of film parts 21' which are made of a non-conductive material and are combined together; and a second electrode layer 23' which is located between the film parts 21' to form the dust collection part 20*b*'. As for this embodiment of the present invention, the first electrode layer 22' and the second electrode layer 23' are separately connected to a power supply P to receive electric power with different voltages, as shown in FIG. 5.

Again referring to FIG. 4, the first electrode layer 22' is arranged on one of the paired film parts 21' while the other of the film parts 21' has a through-hole 21*a*' to expose the first electrode layer 22'.

Therefore, applying electric power to both the first high voltage electrode 20A and the second high voltage electrode 20B may generate a discharge between the first high voltage electrode 20A and the first low voltage electrode 30A to positively charge a pollutant contained in air passing through the first voltage electrode 20A and the first low voltage electrode 30A. The positively charged pollutant as well as the air may flow between the second electrode layer 23' and the low voltage electrodes 30A and 30B so that the positively charged pollutant moves to both the electrodes 30A and 30B at a relatively low voltage, thus being trapped therein.

Figure 6:
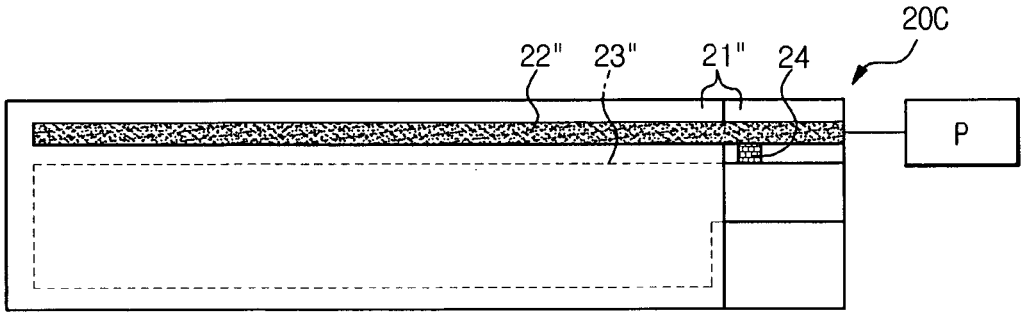
FIG. 6 is a schematic view illustrating the connection of a first high voltage electrode used in an electric precipitator according to another embodiment of the present invention to a power supply.

In the embodiment shown in FIG. 4, although the first electrode layer 22' and the second electrode layer 23' are separately connected to the power supply P to receive electric power with different voltages, the connection is not particularly restricted thereto. For instance, as illustrated in FIG. 6 regarding still another exemplary embodiment of the present invention, the first electrode layer 22" is connected only to the power supply P while the second electrode layer 23" is connected to the first electrode layer 22" through a resistor 24 having a certain resistance value so that electric power is applied to the second electrode layer 23" via the first electrode layer 22" and the resistor 24. As a result, electric power with different voltages may be applied to the first electrode layer 22" and the second electrode layer 23", respectively, through the resistor 24. This embodiment also includes two film parts 21".

In addition, the embodiment shown in FIG. 6 describes a single connection of the first electrode layer 22" to the power supply P in the high voltage electrode 20C, however, it is of course possible that the second electrode layer 23" is connected only to the power supply P while the first electrode layer 22" receives electric power via the second electrode layer 23" and the resistor 24.

The above exemplary embodiments describe that the low voltage electrode 30 is grounded to function as a ground electrode provided in a double-stage type electric precipitator, simultaneously with the basic role of the low voltage electrode. However, embodiments of the present invention are not particularly limited thereto. For instance, it is of course possible to include an alternative ground electrode in the electric precipitator except for the low voltage electrode.

Figure 7:
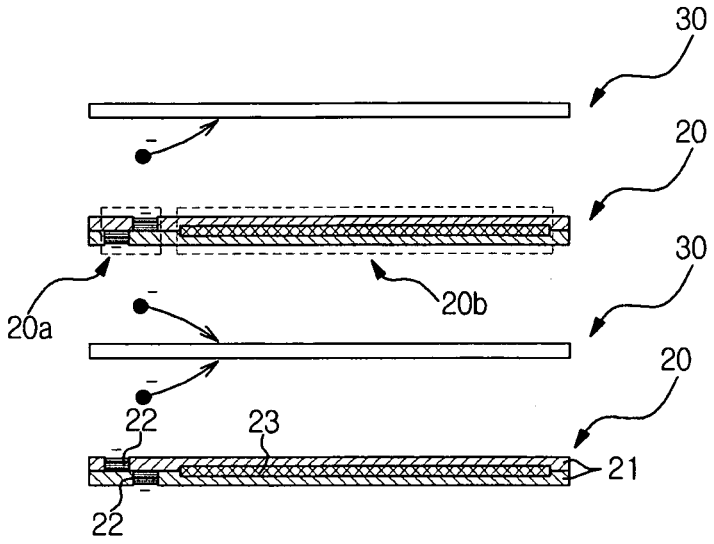
FIG. 7 is a schematic view illustrating the arrangement of high voltage electrodes and low voltage electrodes used in an electric precipitator according to another embodiment of the present invention.

Furthermore, the above exemplary embodiments describe that positive power at a high voltage is applied to the charging part 20*a* in order to positively charge the pollutant, however, embodiments of the present invention are not particularly limited thereto. For instance, another embodiment as shown in FIG. 7 describes that negative power at a high voltage may be applied to the charging part 20*a* to negatively charge the pollutant. As for an indoor electric precipitator, positive high voltage may be applied to the charging part 20*a* as described in the foregoing embodiments.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An electric precipitator to collect a pollutant, comprising:

a high voltage electrode; and a low voltage electrode spaced from the high voltage electrode, wherein the high voltage electrode comprises:

a charging part comprising a first electrode layer to charge the pollutant, and a dust collection part comprising a second electrode layer spaced from the charging part and positioned downstream from the charging part in a flow direction of the pollutant to precipitate the charged pollutant therein.

2. The electric precipitator according to claim 1, wherein the high voltage electrode includes a pair of film parts made of a non-conductive material and combined together, the first electrode layer is formed outside of the film parts, and the second electrode layer is formed between the film parts.

3. The electric precipitator according to claim 2, wherein the first electrode layer is arranged on one of the pair of film parts and the other of the film parts defines a through-hole to expose the first electrode layer.

4. The electric precipitator according to claim 2, wherein the first electrode layer comprises a pair of electrode layers which are arranged on the pair of film parts, respectively, and each of the pair of film parts defines a through-hole to expose the first electrode layer.

5. The electric precipitator according to claim 2, wherein the high voltage electrode has a same width as the low voltage electrode and the high and low voltage electrodes are alternately arranged with and spaced from each other.

6. The electric precipitator according to claim 1, further comprising a plurality of the collection parts, wherein the high voltage electrode includes a first high voltage electrode comprising the charging parts and a first one of the dust collection parts and a second high voltage electrode comprising a second one of the collection parts, and the low voltage electrode includes a first low voltage electrode having a same width as the first high voltage electrode and a second low voltage electrode having a same width as the second high voltage electrode.

7. The electric precipitator according to claim 6, wherein the first high voltage electrode is spaced from the first low voltage electrode, and at least one of the second high voltage electrode and the second low voltage electrode is arranged between the first high voltage electrode and the first low voltage electrode.

8. The electric precipitator according to claim 2, wherein the first electrode layer comprises conductive fibers.

9. The electric precipitator according to claim 1, further comprising a power supply to provide electric power to the high voltage electrode, wherein the power supply applies electric power with different voltages to the charging part and the dust collection part.

10. The electric precipitator according to claim 1, further comprising:

a power supply to provide electric power to the high voltage electrode and;

a resistor to connect the charging part and the dust collection part, wherein the power supply is connected to only the charging part or the dust collection part.

11. A high voltage electrode to collect a pollutant, comprising:

a charging part comprising a first electrode layer to charge the pollutant; and a dust collection part comprising a second electrode layer which is spaced from the charging part and is positioned downstream relative to the charging part in a flow direction of the charging part to precipitate the charged pollutant therein.

12. The high voltage electrode according to claim 11, wherein the high voltage electrode includes a pair of film parts made of a non-conductive material and combined, the first electrode layer is formed outside of the film parts, and the second electrode layer is formed between the film parts.

13. The high voltage electrode according to claim 12, wherein the first electrode layer is arranged on one of the film parts and the other of the film parts defines a through-hole to expose the second electrode layer.

14. The high voltage electrode according to claim 12, wherein the first electrode layer comprises a pair of electrode layers which are arranged on the film parts, respectively, and each of the film parts defines a through-hole to expose the first electrode layer arranged on the film parts.

15. The high voltage electrode according to claim 12, wherein the first electrode layer comprises conductive fibers.

16. The high voltage electrode according to claim 11, wherein electric power with different voltages is applied to the charging part and the dust collection part.

17. The high voltage electrode according to claim 11, further comprising a resistor to connect the charging part and the dust collection part, wherein electric power is applied to either the charging part or the dust collection part.

* * * * *